US010465899B2

(12) United States Patent
Goerts

(10) Patent No.: US 10,465,899 B2
(45) Date of Patent: Nov. 5, 2019

(54) LIGHTING DEVICE COMPRISING AN IMPROVED OPTICAL ELEMENT

(71) Applicant: SIGNIFY HOLDING B.V., Eindhoven (NL)

(72) Inventor: Walter Johannes Marie Goerts, Heesch (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/542,926

(22) PCT Filed: Dec. 30, 2015

(86) PCT No.: PCT/EP2015/081415
§ 371 (c)(1),
(2) Date: Jul. 11, 2017

(87) PCT Pub. No.: WO2016/113114
PCT Pub. Date: Jul. 21, 2016

(65) Prior Publication Data

US 2018/0023797 A1 Jan. 25, 2018

(30) Foreign Application Priority Data

Jan. 13, 2015 (EP) ..... 15150877

(51) Int. Cl.

| | |
|---|---|
| ***F21V 3/00*** | (2015.01) |
| ***F21V 5/00*** | (2018.01) |
| ***F21V 31/00*** | (2006.01) |
| ***F21V 5/04*** | (2006.01) |
| ***F21V 15/01*** | (2006.01) |
| ***F21V 3/06*** | (2018.01) |

(Continued)

(52) U.S. Cl.
CPC ..... *F21V 31/005* (2013.01); *F21V 3/061* (2018.02); *F21V 5/04* (2013.01); *F21V 15/01* (2013.01); *F21V 17/002* (2013.01); *F21V 17/06* (2013.01); *F21V 31/00* (2013.01); *F21Y 2115/10* (2016.08)

(58) Field of Classification Search
CPC ..... F21V 3/061; F21V 3/0615; F21V 3/062; F21V 3/0625; F21V 5/04; F21V 5/046; F21V 5/048; F21V 15/01; F21V 17/002; F21V 17/06; F21V 31/00; F21V 31/005; F21Y 2115/10
USPC ..... 362/249.02, 311.02, 800; 257/79–103
See application file for complete search history.

(56) References Cited

U.S. PATENT DOCUMENTS 8,684,568 B2 * 4/2014 Nagaoka ..... F21V 17/12 362/374
2007/0189013 A1 8/2007 Ford
(Continued)

FOREIGN PATENT DOCUMENTS

CN 101776256 A 7/2010
EP 2345840 A2 7/2011
(Continued)

*Primary Examiner* — Jason M Han
(74) *Attorney, Agent, or Firm* — Daniel J. Piotrowski

(57) ABSTRACT

A lighting device comprising an optical device, a carrier, a light source and a gasket is provided. The optical device has a protrusion with a series of stepped faces. The gasket acts upon one of the faces to provide sealing against environmental factors while a second face determines the distance between the light source and a light exit window of the optical device.

8 Claims, 5 Drawing Sheets

(51) Int. Cl.

| | |
|---|---|
| ***F21V 17/00*** | (2006.01) |
| ***F21V 17/06*** | (2006.01) |
| *F21Y 115/10* | (2016.01) |

(56) References Cited

U.S. PATENT DOCUMENTS

| | | | |
|---|---|---|---|
| 2008/0084693 | A1 | 4/2008 | Shimada et al. |
| 2011/0280020 | A1 | 11/2011 | Chen et al. |
| 2014/0211474 | A1 | 7/2014 | Juan et al. |

FOREIGN PATENT DOCUMENTS

| | | | |
|---|---|---|---|
| EP | 2492591 | A2 | 8/2012 |
| JP | 2010205645 | A | 9/2010 |

* cited by examiner

LIGHTING DEVICE COMPRISING AN IMPROVED OPTICAL ELEMENT

CROSS-REFERENCE TO PRIOR APPLICATIONS

This application is the U.S. National Phase application under 35 U.S.C. § 371 of International Application No. PCT/EP2015/081415, filed on Dec. 30, 2015 which claims the benefit of European Patent Application No. 15150877.7, filed on Jan. 13, 2015. These applications are hereby incorporated by reference herein.

FIELD OF THE INVENTION

The present invention relates to a lighting device.

The present invention also relates to a method of manufacturing the lighting device.

BACKGROUND OF THE INVENTION

Lenses for light sources are often manufactured from glass due to its inherent stability over long lifetimes, it is not affected by UV and it is cheap to use as a base material. Glass is also electrically inert and does not attract dust and also has the added environmental benefit that it is easy to recycle.

SUMMARY OF THE INVENTION

The invention seeks to provide a lighting device that has a separate face for providing a seal and a separate face for determining a distance between a light source and the exit window of an optical device. This may have the advantage of removing the requirement for any post production processes such as grinding or polishing. The grinding process produces a flat but matte finish which then requires polishing to restore a transparent surface. A further advantage is that the lighting device has a more consistent sealing between a carrier and an optical device.

According to an aspect there is provided a lighting device comprising:

a carrier having an upper surface and a recess comprising a gasket, an optical device for imparting a shape to a light beam, a light source located on the upper surface of the carrier for emitting light towards the optical device, wherein the optical device has a base, the base comprising:

a first surface for determining the distance from the light source to an exit window of the optical device by engaging with the upper surface of the carrier, and a protrusion extending into the recess of the carrier, wherein the recess has a depth that is greater than the length of the protrusion, and wherein the gasket directly acts upon a protrusion side wall.

Such a lighting device may reduce the number of manufacturing processes that are required to ensure that the correct distance from the light source to a light exit window of the optical device is achieved.

The removal of the processes reduces the time and therefore cost of manufacture and it also reduces scrap as it may be difficult to accurately hold an optical device such that the base can be ground to the correct dimension, they optical device may be held at an angle which would lead to grinding a wedge profile and this wedge may mean that the optical device may not apply equal pressure to the gasket, leading to leaks or that the optical characteristics of the beam may be altered by the optical device being incorrectly ground. Both of these defects would result in rejection of the optical device.

The polishing step is required to remove the surface marks left by the grinding process.

The removal of the post production processes by separating the functionalities of sealing and optical management by providing a separate face within the optical device for each functionality is an important aspect as the optical device shapes the light beam emitted by the light source to suit the desired characteristics required of the lighting device, it can be seen that the requirements for a lighting device used for street lighting are very different to those required of a lighting device used for general illumination within the home.

If the lighting device is to be used outside then environmental factors also come into play, it is generally desired for the lighting device to be unaffected by environmental factors such as precipitation, humidity, UV light exposure etc. To combat the effects of precipitation or humidity upon the lighting device it is desirable to seal the light source within the lighting device. There is a standardized protection rating system known as the IP (International Protection, sometimes interpreted as Ingress Protection) rating. The level of protection is denoted by a two letter code following the IP letters (IPxx).

The first numeral indicates the level of protection that is provided against access to hazardous parts (for example electrical items) and the ingress of solid foreign objects.

| Level | Object size protected against | Effective against |
|---|---|---|
| 0 | — | No protection against contact and ingress of objects |
| 1 | >50 mm | Any large surface of the body, such as the back of a hand, but no protection against deliberate contact with a body part. |
| 2 | >12.5 mm | Fingers or similar objects |
| 3 | >2.5 mm | Tools, thick wires etc. |
| 4 | >1 mm | Most wires, screws etc. |
| 5 | Dust protected | Ingress of dust is not entirely prevented, but must not enter in sufficient quantity to interfere with the satisfactory operation of the equipment; complete protection against contact. |
| 6 | Dust tight | No ingress of dust; complete protection against contact |

The second numeral indicates the level of protection that is provided against harmful ingress of water.

| Level | Protected against | Testing for | Details |
|---|---|---|---|
| 0 | Not protected | N/A | N/A |
| 1 | Dripping water | Dripping water (vertically falling drops) shall have no harmful effect | Test duration: 10 minutes<br>Water equivalent to 1 mm rainfall per minute |
| 2 | Dripping water when tilted up to 15° | Vertically dripping water shall have no harmful effect when the enclosure is tilted at an angle up to 15° from its normal position | Test duration: 10 minutes<br>Water equivalent to 3 mm rainfall per minute |

-continued

| Level | Protected against | Testing for | Details |
|---|---|---|---|
| 3 | Spraying water | Water falling as a spray at any angle up to 60° from the vertical shall have no harmful effect. | Test duration: 5 minutes Water volume: 0.7 liters per minute Pressure: 80-100 kPa |
| 4 | Splashing of water | Water splashing against the enclosure from any direction shall have no harmful effect | Test duration: 5 minutes Water volume: 10 liters per minute Pressure: 80-100 kPa |
| 5 | Water Jets | Water projected by a nozzle (6.3 mm) against enclosure from any direction shall have no harmful effects | Test duration: at least 3 minutes Water volume: 12.5 liters per minute Pressure: 30 kPa at a distance of 3 m |
| 6 | Powerful water jets | Water projected in powerful jets (12.5 mm nozzle) against the enclosure from any direction shall have no harmful effects | Test duration: at least 3 minutes. Water volume 100 liters per minute. Pressure: 100 kPa at distance of 3 m |
| 6K | Powerful water jets with increased pressure | Water projected in powerful jets (6.3 mm nozzle) against the enclosure from any direction, under elevated pressure, shall have no harmful effects. | Test duration: at least 3 minutes. Water volume: 75 liters per minute. Pressure: 1000 kPa at distance of 3 m. |
| 7 | Immersion up to 1 m | Ingress of water in harmful quantity shall not be possible when the enclosure is immersed in water under defined conditions of pressure and time (up to 1 m of submersion) | Test duration: 30 minutes Immersion at depth of at most 1 m measured at bottom of device and at least 15 cm measured at top of device. |
| 8 | Immersion beyond 1 m | The equipment is suitable for continuous immersion in water under conditions which will be specified by the manufacturer. However, with certain types of equipment, it can mean that water can enter, but only in such a manner that it produces no harmful effects | Test duration: continuous immersion in water Depth specified by manufacturer, generally up to 3 m |
| 9K | Powerful high temperature water jets | Protected against close-range high pressure, high temperature spray downs. | N/A |

It is desirable in one embodiment to provide an IP66 rating. To achieve this rating there must be a reliable seal between the optical device and the carrier.

These and other aspects of the invention will be apparent from and elucidated with reference to the embodiment(s) described hereinafter.

DETAILED DESCRIPTION OF THE EMBODIMENTS

Figure 1:
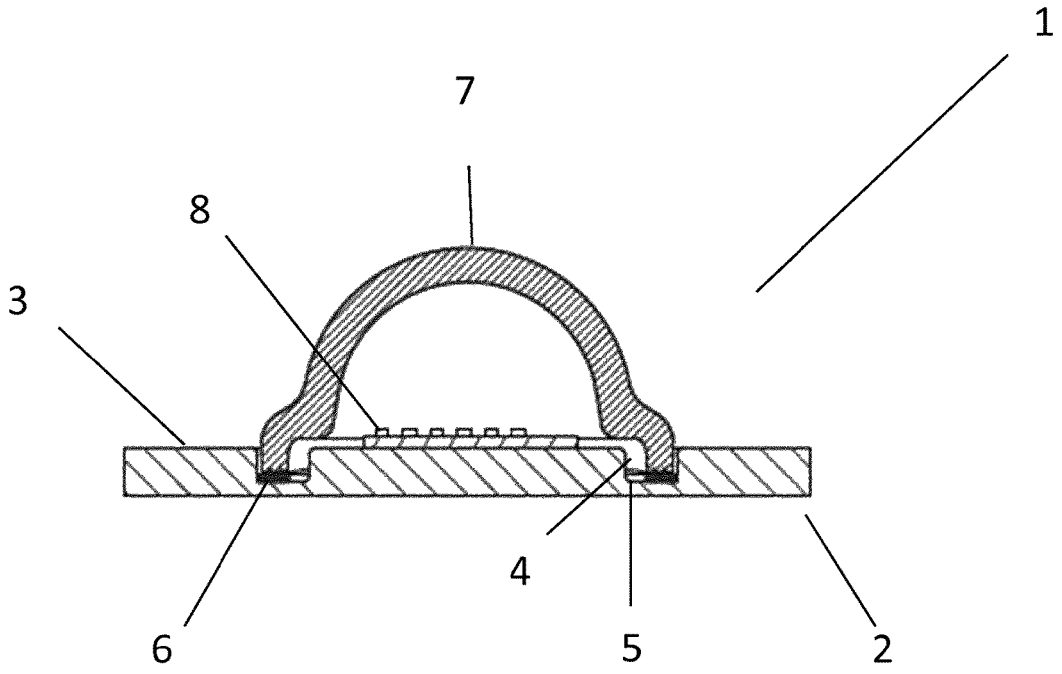
FIG. 1 shows a cross sectional view of a prior art lighting device.

It should be understood that the Figures are representative and are not drawn to scale. It should also be understood that the same reference numerals are used throughout the Figures to indicate the same or similar parts.

FIG. 1 shows a cross sectional view of a prior art lighting device 1. The carrier 2 has an upper face 3. The upper face also has a recess 4.

Figure 2:
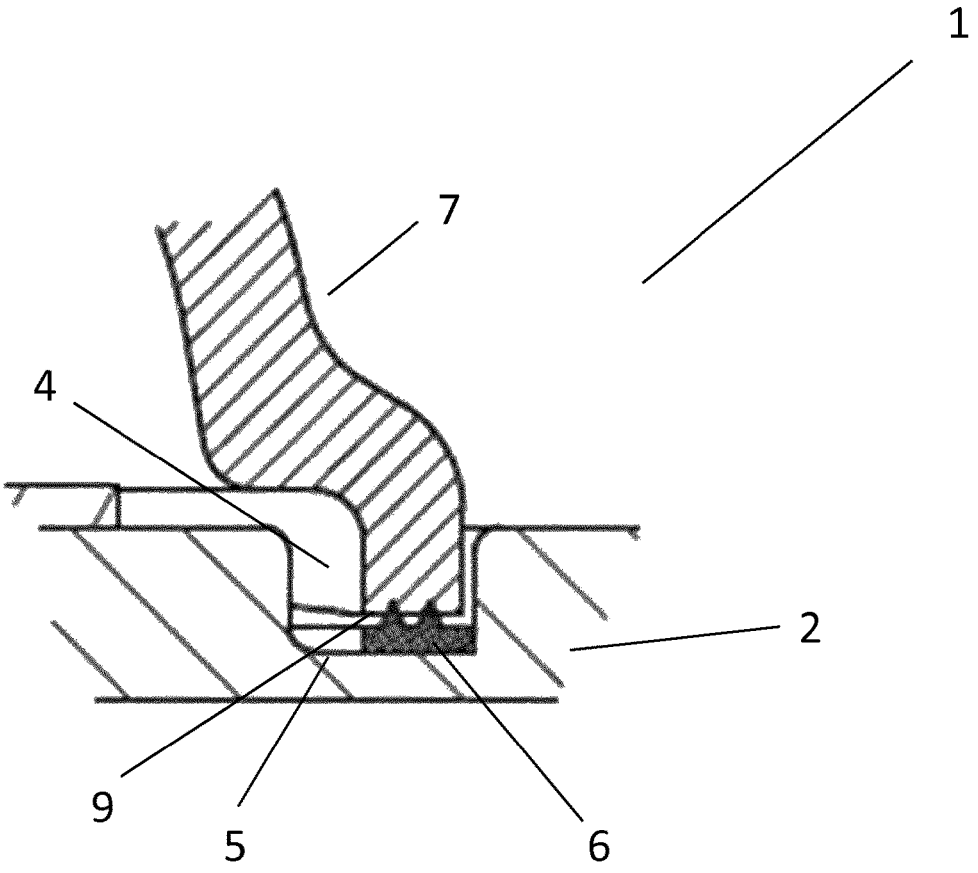
FIG. 2 shows an enlarged cross sectional view of a prior art lighting device located within a recess.

Located on the bottom face 5 of the recess 4 is a gasket 6 (these can be more readily seen in FIG. 2). A gasket is a mechanical seal which fills the space between two or more mating surfaces, generally to prevent leakage from or into the joined objects while under compression. It is usually desirable that the gasket is made from a material that allows a degree of yielding or deformation. This allows the gasket to deform and to tightly fill the available space between the mating surfaces, including any slight irregularities. The gasket is not always provided as a separate component. The seal may be formed using an adhesive or a sealant.

An optical device 7 is located on the gasket 6 and the gasket seals the optical device 7 to the carrier 2. This seal provides a barrier to the ingress of environmental factors such as precipitation, humidity, dust, gases such as $H_2S$, etc. and stops the environmental factors from affecting the light source 8.

The gasket 6 may be made from an elastomer, these may take the form of an "O-ring" or any other suitably shaped gasket. An O-ring may have a circular cross section and is designed to sit in a groove (recess 4) and compressed between two parts during assembly (the optical device 7 and the carrier 2), this compression forms a seal at the interface between the two parts. O-rings are commonly used in this configuration as they are inexpensive, easy to make and are reliable as they have simple mounting requirements. The O-ring can be produced by extrusion, injection molding, pressure molding or transfer molding.

To ensure a successful O-ring joint a rigid mounting that applies a predictable deformation to the O-ring is required. This introduces a mechanical stress at the O-ring contact services that can be calculated to remain below the limits of the O-ring. As long as the pressure of the liquid does not exceed the contact stress of the O-ring, leaking cannot occur. The most common reason for O-Ring failure is extrusion of the ring through the mating surfaces, i.e., between the optical device 7 and the carrier 2.

A suitable gasket 6 may be manufactured from a Natural Butile Rubber (NBR) a polytetraflouroethylene (PTFE) or it could be a spiral wound gasket. The spiral wound gasket is more expensive as it requires more expensive materials and a more complex production process. A Spiral wound gasket comprises a mix of metallic and filler material. The gasket may have a metal (such as stainless steel) wound outwards in a circular spiral with the filler material (such as a flexible graphite) wound in the same manner but starting from the opposite side. This results in alternating layers of filler and metal. The filler provides the seal whilst the metal acts as a structural support.

FIG. 2 shows an enlarged view of a prior art device 1, more specifically, it shows an enlarged view of the interaction between the optical device 7, the gasket 6 and the recess 4 in the carrier 2. It can be seen that the gasket 6 acts upon a face 9 of the optical device 7.

Figure 3:
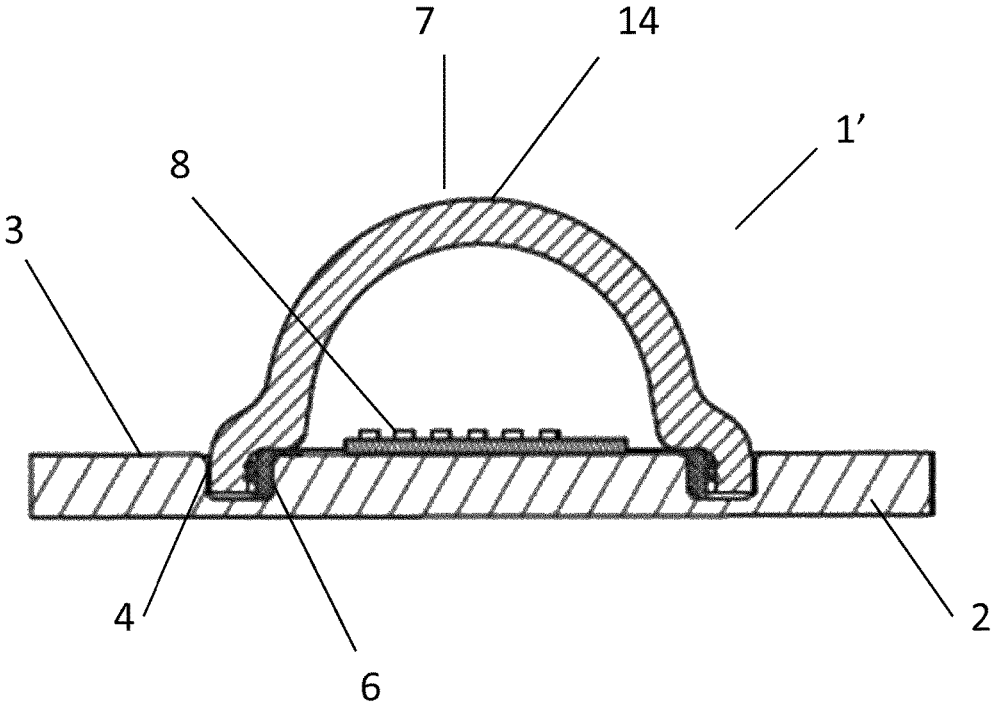
FIG. 3 shows a cross sectional view of a lighting device according to an embodiment of the present invention.

FIG. 3 shows a cross sectional view of a lighting device 1' according to an embodiment of the present invention. The optical device 7 is located in the recess 4 of the carrier 2 and the gasket 6 is located on a side wall 10 of the recess 4. This can be seen more clearly in FIG. 4.

Figure 4:
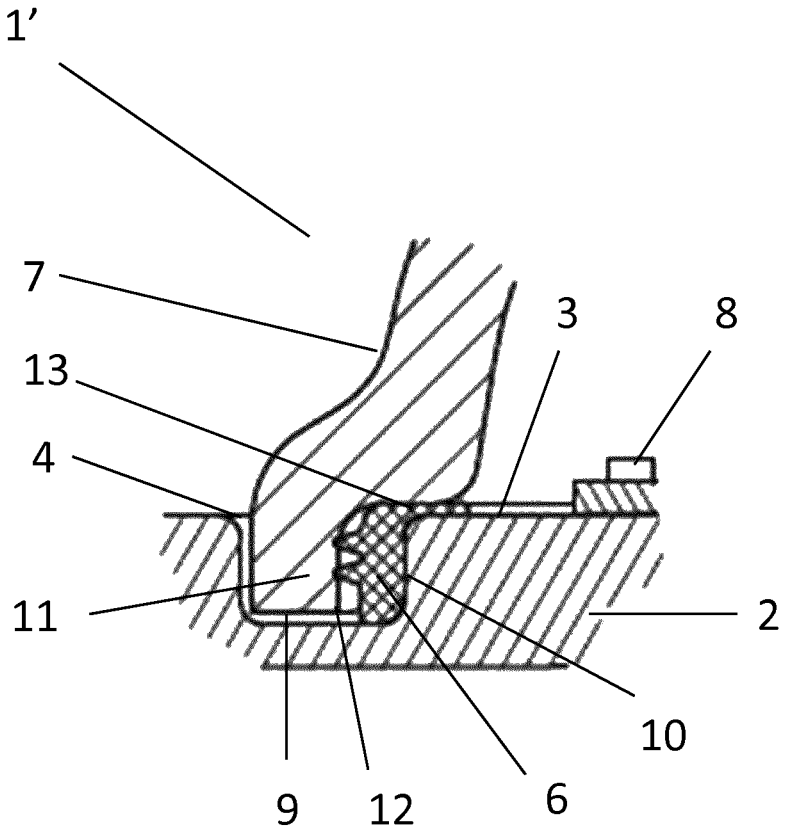
FIG. 4 shows an enlarged cross sectional view of a lighting device according to an embodiment of the present invention.

FIG. 4 shows an enlarged cross sectional view of a lighting device 1' according to an embodiment of the present invention. The carrier 2 has a top surface 3 with a recess 4. The optical device 7 has a protrusion 11 with a side face 12. The gasket 6 is located on a side wall 10 of the recess 4 and acts axially on the side face 12 of the protrusion 11. This has the advantage that the face 12 of the optical device 7 is a separate face to the face 13 of the optical device that determines the distance from the light source 8 to the light exit window 14 of the optical device 7. The length of the protrusion 11 is no longer a critical dimension in determining the quality of the sealing.

The depth of the recess should be considered as including the gasket if the gasket extends across the bottom surface of the recess and not including the gasket if the gasket does not extend across the bottom surface. This means that as long as the depth of the recess is greater than the length of the protrusion the distance from the light source to the light exit window of the optical device is not affected by any variation in the length of the protrusion.

This removal of dependence upon manufacturing tolerances to be observed allows the post-processing steps of grinding the extension to the desired length and then polishing to remove the surface marks left by the grinding process.

Separating the two functionalities of sealing and optical distance from the light source to the light exit window of the optical device means that the optical device 7 can be manufactured in a more simplified manner, this brings both time saving and economical benefits. An optical device 7 according to an embodiment of the invention is molded from glass.

Glass is an amorphous (that is to say a non-crystalline) solid material which is often transparent. Historically, most types of glass are based on the chemical compound silica (silicon dioxide) which is the primary constituent of sand. Of the many silica-based glasses that are in existence, ordinary glazing and container glass is formed from a specific type known as soda-lime glass. Soda-lime glass is typically composed of approximately 75% silicon dioxide ($SiO_2$), sodium oxide ($Na_2O$) from sodium carbonate ($Na_2CO_3$) lime (CaO) and several minor additives.

Fused quartz glass is relatively chemically pure silica ($SiO_2$) which is used for special glass applications such as when UV light is to be transmitted, due to its high transmission of UV. It has a high melting point of approximately 2000° C. which is usually reached in an electrically heated furnace or a gas/oxygen fuelled furnace. It has a high strength compared to ordinary glass and due to its extremely low coefficient of thermal expansion can withstand large, rapid temperature changes (known as thermal shock).

However, not all of these qualities are required in all products and obviously, the fused quartz glass is more expensive to manufacture than ordinary glass. Normally, other substances are added to simplify the production process. One substance is sodium carbonate ($Na_2CO_3$) as this lowers the glass transition temperature, however this has the unwanted effect of making the glass water soluble, lime (CaO), magnesium oxide (MgO) and Aluminium Oxide ($Al_2O_3$) are added to counteract this and to provide better chemical durability. The soda-lime glass has a high thermal expansion and poor resistance to heat and so sodium borosilicate glass having the additional ingredient of boric oxide ($B_2O_3$) is often used when a higher thermal resistance is required and they are often used in the manufacture of optical components.

Many applications of silica based glasses derive from their optical transparency, this quality leads them to be used primarily for window panes. Glass is both reflective and refractive of light.

Glass can be molded using a variety of techniques, such as hot casting, pressing, blowing, precision molding etc. Pressing is a technique wherein molten glass that is heated to around 1200° C. is poured into a mold, a plunger is then used to press the molten glass into the mold, the plunger can be substituted by a second part of a two part mold. The molten glass is known as a gob of glass. The raw material is generally stored in large silos and then mixed in a batch house. The glass mixture is then known as a "batch", this batch is then sent to the furnace which is located in the "hot end".

The hot end of a glass works is where the molten glass is formed into the required products, this begins when the batch is fed into the furnace at a controlled rate by the batch processing system. The furnaces are typically natural gas or fuel oil fired and operate at temperatures in the region of 1500° C. This temperature is only limited by the construction of the furnace and the glass composition.

The stream of molten glass that exits the furnace at its plastic temperature (1050° C.-1200° C.) is cut with a shearing blade to form a solid cylinder of glass known as a gob. These are guided by a series of troughs and chutes into the female part of a mold wherein the plunger (also known as the male part of the mold) is then pressed into the gob to form the desired final shape.

The male part is pressed into the molten glass until a predetermined distance between the female and male parts is achieved. This distance will correspond to the thickness desired for the optical device 7 (not including the shrinkage allowance).

As said above a gob is a specific amount of molten glass which will be formed into a final product, in this case an optical device 7. There are often differences in the amount of glass in each gob. When the male part of the mold is forced into the female part to form the gob into the optical device 7 then any excess molten glass will be extruded out of the mold in the region of the face 9 of the optical device. As the face 9 is not used for sealing against the gasket 6 nor is it used to determine the distance between the light source 8 and the light exit window 14 of the optical device 7 any excess glass in this region does not affect the IP rating or the optical properties of the lighting device 1' provided that the length of the protrusion will not be greater than the depth of the recess.

After the gob is pressed in the mold it may require annealing, this is because glass shrinks as it cools and solidifies. This can cause problems as an uneven cooling process may cause weak glass due to internal stresses. This can be mitigated by ensuring an even cooling using a process called annealing. An annealing oven heats the final product to approximately 580° C. and cools it dependent on requirements, over a period of 20-6000 minutes.

A mold that can form the two separate faces 12 and 13 of the optical device 7 can be manufactured, the male part has a stepped lip near the top of the male and thus when the stepped male part is forced into the gob of molten glass within the female part it forms the optical device 7 having a face 13 which is used to determine the distance from the light source 8 to the light exit window 14 and a face 12 which is used with the gasket 6 to provide sealing.

Using the mold described above means that any excess glass in the mold caused by the gob being oversized will extrude in the region of face 9 of the optical device 7. If the carrier 2 is manufactured with a recess 4 that is deeper than any maximum distance between faces 13 and 9 of the optical device then no additional processes such as grinding or polishing are required to ensure good sealing of the optical device 7 to the carrier 2 or the correct distance between the light source 8 and the light exit window 14.

The gasket 6 may be located fully on the sidewall 10 of the recess 4 within the carrier 2 or it may be partly located on the top face 3 of the carrier 2. Locating part of the gasket 6 on the top face 3 may cushion the optical device 7 and protect face 13 if the optical device 7 receives a sudden physical force, such as, for example it is struck by an object.

Figure 5:
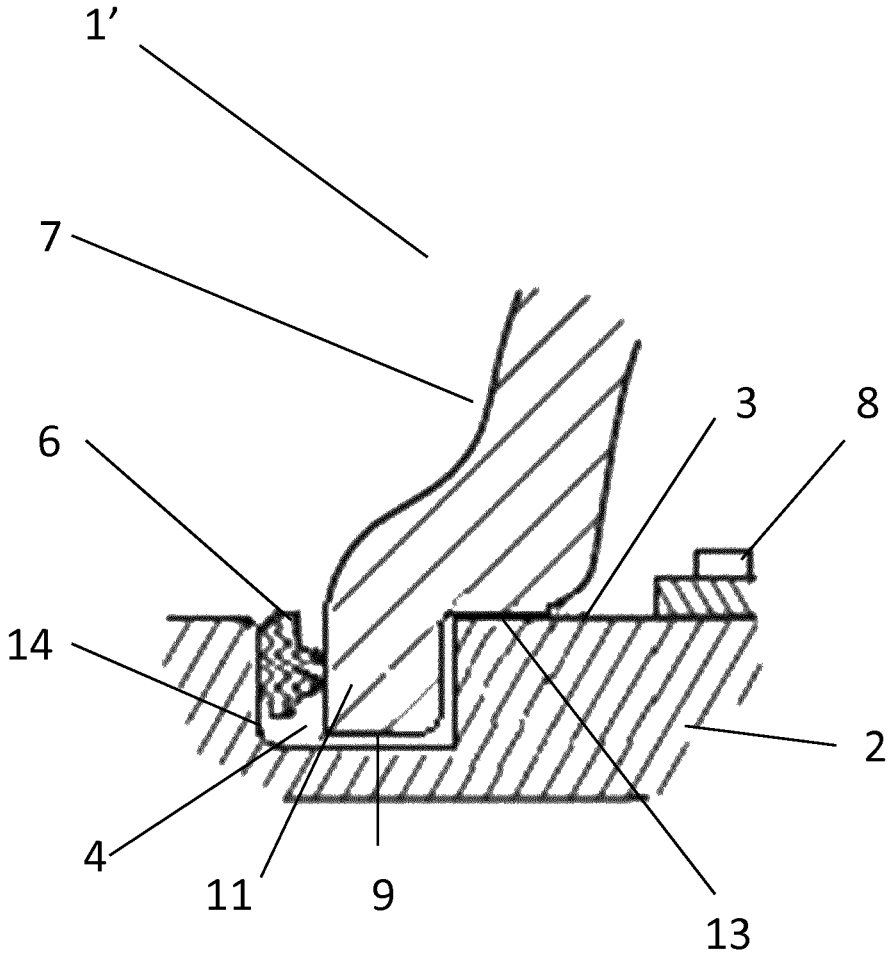
FIG. 5 shows an enlarged cross sectional view of a lighting device according to a further embodiment of the present invention.

FIG. 5 shows a further embodiment of a lighting device 1'. The gasket 6 is located in the recess 4 of the carrier 2. The gasket is located on the side wall 14. The face 13 of the optical device 7 is located directly on the upper face 3 of the carrier 2. The gasket 6 in this embodiment may be fitted within the recess 4 after the protrusion 11 of the optical device 7 has been located in the recess 4. The gasket 6 may be further secured by the addition of a cover plate (not shown) which will protect the gasket from any external forces such as a jet of water.

The invention claimed is:

1. A lighting device comprising:

a carrier having an upper surface and a recess comprising a gasket, an optical device for imparting a shape to a light beam, a light source located on the upper surface of the carrier for emitting light towards the optical device, wherein the optical device has a base, the base comprising:

a first surface for determining a distance from the light source to an exit window of the optical device by engaging with the upper surface of the carrier, wherein the distance provides a predetermined light characteristic of the lighting device, and a protrusion extending into the recess of the carrier, the protrusion terminating at a bottom face, wherein the recess has a depth that is greater than the length of the protrusion, such that a gap exists between the bottom face of the protrusion and the bottom of the recess, wherein at least part of the gap is free of any part of the gasket, and wherein the gasket directly acts upon a protrusion side wall to provide a seal between the carrier and the optical device.

2. A lighting device according to claim 1 wherein the optical device base further comprises a recess to accommodate the light source.

3. A lighting device according to claim 1 wherein the optical device is affixed to the carrier by a fixing plate that surrounds the optical device and is removably attached to the carrier.

4. A lighting device according to claim 3 wherein the fixing plate has:

an upper surface, a lower surface, and a through hole between the upper surface and the lower surface, said through hole corresponding to the shape of an upper region of the optical device, wherein the lower surface of the fixing plate engages with an upper surface of the base of the optical element and removably attaches the optical device to the carrier.

5. A lighting device according to claim 1 wherein the gasket is provided at least partly on a side wall of the recess within the carrier and at least partly on the upper surface of the carrier.

6. A lighting device according to claim 1 wherein the optical device is produced by molding.

7. A lighting device according to claim 1 wherein the optical device is manufactured from glass.

8. A lighting device comprising:

a carrier having an upper surface and a recess comprising a gasket, an optical device for imparting a shape to a light beam, a light source located on the upper surface of the carrier for emitting light towards the optical device, wherein the optical device has a base, the base comprising:

a first surface for determining a distance from the light source to an exit window of the optical device by engaging with the upper surface of the carrier, wherein the distance provides a predetermined light characteristic of the lighting device, and a protrusion extending into the recess of the carrier, the protrusion terminating at a bottom face, wherein the recess has a depth that is greater than the length of the protrusion, such that a gap exists between the bottom face of the protrusion and the bottom of the recess, wherein the gap is free of any part of the gasket, and wherein the gasket directly acts upon a protrusion side wall to provide a seal between the carrier and the optical device.

* * * * *